US011427920B2

(12) United States Patent
Hoshino et al.

(10) Patent No.: US 11,427,920 B2
(45) Date of Patent: Aug. 30, 2022

(54) ELECTROLYTIC PROCESSING JIG AND ELECTROLYTIC PROCESSING METHOD

(71) Applicant: Tokyo Electron Limited, Tokyo (JP)

(72) Inventors: Tomohisa Hoshino, Kumamoto (JP); Masato Hamada, Kumamoto (JP); Satoshi Kaneko, Kumamoto (JP); Kiyomitsu Yamaguchi, Kumamoto (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 274 days.

(21) Appl. No.: 16/330,805

(22) PCT Filed: Sep. 7, 2017

(86) PCT No.: PCT/JP2017/032321

§ 371 (c)(1),
(2) Date: Mar. 6, 2019

(87) PCT Pub. No.: WO2018/066297

PCT Pub. Date: Apr. 12, 2018

(65) Prior Publication Data

US 2019/0233963 A1 Aug. 1, 2019

(30) Foreign Application Priority Data

Oct. 7, 2016 (JP) ..... JP2016-198728

(51) Int. Cl.

| | |
|---|---|
| ***C25D 5/00*** | (2006.01) |
| ***C25D 5/02*** | (2006.01) |
| ***C25D 17/00*** | (2006.01) |
| ***C25D 7/12*** | (2006.01) |
| ***C25D 5/04*** | (2006.01) |
| ***C25D 17/12*** | (2006.01) |
| ***C25D 17/06*** | (2006.01) |

(Continued)

(52) U.S. Cl.
CPC ..... *C25D 5/003* (2013.01); *C25D 5/022* (2013.01); *C25D 5/04* (2013.01); *C25D 5/08* (2013.01);

(Continued)

(58) Field of Classification Search
CPC ..... C25D 7/12–123; C25D 17/00; C25D 17/001; C25D 17/005; C25D 17/007;

(Continued)

(56) References Cited

U.S. PATENT DOCUMENTS 6,652,726 B1 * 11/2003 Chou ..... C25D 7/12 205/143
2003/0213697 A1 11/2003 Chou (Continued)

FOREIGN PATENT DOCUMENTS

CN 1067455 A 12/1992
CN 101928954 A 12/2010

(Continued)

OTHER PUBLICATIONS

International Search Report for International Application No. PCT/JP2017/032321, dated Dec. 5, 2017.

*Primary Examiner* — Alexander W Keeling
(74) *Attorney, Agent, or Firm* — Pearne & Gordon LLP

(57) ABSTRACT

An electrolytic processing jig configured to perform an electrolytic processing on a processing target substrate by using a processing liquid supplied to the processing target substrate includes a base body having a flat plate shape; and a direct electrode provided on a front surface of the base body and configured to be brought into contact with the processing liquid to apply a voltage between the processing target substrate and the direct electrode. An irregularity pattern is formed on a front surface of the electrolytic processing jig at a processing target substrate side.

6 Claims, 13 Drawing Sheets

(51) Int. Cl.

| | |
|---|---|
| ***C25D 21/12*** | (2006.01) |
| ***C25D 15/02*** | (2006.01) |
| ***C25D 5/08*** | (2006.01) |
| *C25D 21/04* | (2006.01) |

(52) U.S. Cl.
CPC ..... *C25D 5/605* (2020.08); *C25D 7/123* (2013.01); *C25D 15/02* (2013.01); *C25D 17/001* (2013.01); *C25D 17/007* (2013.01); *C25D 17/06* (2013.01); *C25D 17/12* (2013.01); *C25D 21/12* (2013.01); *C25D 21/04* (2013.01)

(58) Field of Classification Search
CPC ..... C25D 17/06; C25D 17/10; C25D 21/00; C25D 21/04; C25D 21/12
See application file for complete search history.

(56) References Cited

U.S. PATENT DOCUMENTS

2005/0145482 A1* 7/2005 Suzuki ..... C25D 17/001 204/199
2008/0121526 A1* 5/2008 Hsiao ..... C25D 17/12 205/80
2010/0320082 A1 12/2010 Kato et al.
2013/0098769 A1* 4/2013 Iwatsu ..... H01L 25/0657 204/229.8
2016/0083856 A1 3/2016 Iwatsu et al.
2016/0326663 A1 11/2016 Iwatsu

FOREIGN PATENT DOCUMENTS

| | | | |
|---|---|---|---|
| CN | 104532336 | A | 4/2015 |
| CN | 105229205 | A | 1/2016 |
| JP | H6-212470 | A | 8/1994 |
| JP | 2003-129297 | A | 5/2003 |
| JP | 2003-528219 | A | 9/2003 |
| JP | 2004-043952 | A | 2/2004 |
| JP | 2004-250747 | A | 9/2004 |
| JP | 2006-265709 | A | 10/2006 |
| JP | 2015-004124 | A | 1/2015 |
| WO | 01/71066 | A1 | 9/2001 |
| WO | 2015/104951 | A1 | 7/2015 |

* cited by examiner

ELECTROLYTIC PROCESSING JIG AND ELECTROLYTIC PROCESSING METHOD

CROSS-REFERENCE TO RELATED APPLICATION

This application claims the benefit of Japanese Patent Application No. 2016-198728 filed on Oct. 7, 2016, the entire disclosures of which are incorporated herein by reference.

TECHNICAL FIELD

The embodiments described herein pertain generally to an electrolytic processing jig configured to perform an electrolytic processing on a processing target substrate by using a processing liquid supplied onto the processing target substrate and an electrolytic processing method using the electrolytic processing jig.

BACKGROUND

An electrolytic process (electrolytic processing) is a technique used in various kinds of processings such as a plating processing and an etching processing. For example, the electrolytic processing is performed in a manufacturing process for a semiconductor device.

The aforementioned plating processing is conventionally performed by a plating apparatus described in Patent Document 1, for example. In the plating apparatus, an anode electrode made of, by way of example, platinum in a mesh shape is placed in a plating cup, and a semiconductor wafer is placed to face the anode electrode with a plating target surface thereof facing downwards. Further, a supporting member configured to support the semiconductor wafer constitutes a cathode electrode connected to the semiconductor wafer. By flowing a plating liquid toward the plating target surface of the semiconductor wafer through the anode electrode within the plating cup, the plating processing is performed on the semiconductor wafer.

Further, the plating apparatus disclosed in Patent Document 1 is equipped with an ultrasonic oscillator, and by delivering an ultrasonic wave generated from this ultrasonic oscillator to the plating liquid, the plating liquid is agitated, so that uniformity of the plating processing is improved.

PRIOR ART DOCUMENT

Patent Document 1: Japanese Patent Laid-open Publication No. 2004-250747

DISCLOSURE OF THE INVENTION

Problems to be Solved by the Invention

When the plating apparatus described in Patent Document 1 is used, however, since this plating apparatus has the configuration in which the plating liquid is flown, the structure of the apparatus is complicated. Further, since the ultrasonic oscillator for agitating the plating liquid is required to improve the uniformity of the plating processing, a large-scale agitating device is also needed.

In view of the foregoing, exemplary embodiments provide a technique capable of performing an electrolytic processing on a processing target substrate efficiently and appropriately.

Means for Solving the Problems

In an exemplary embodiment, there is provided an electrolytic processing jig configured to perform an electrolytic processing on a processing target substrate by using a processing liquid supplied to the processing target substrate. The electrolytic processing jig includes a base body having a flat plate shape; and a direct electrode provided on a front surface of the base body and configured to be brought into contact with the processing liquid to apply a voltage between the processing target substrate and the direct electrode. An irregularity pattern is formed on a front surface of the electrolytic processing jig.

According to the exemplary embodiment, by applying the voltage between the direct electrode and the processing target substrate after bringing the direct electrode into contact with the processing liquid by moving the electrolytic processing jig and the processing target substrate to be adjacent to each other relatively, the electrolytic processing can be performed on the processing target substrate appropriately. Further, the electrolytic processing jig according to the present exemplary embodiment does not have a conventional configuration in which the processing liquid is flown and does not require a large-scale agitating device for agitating the processing liquid. Therefore, the apparatus configuration can be simplified.

Here, if the front surface of the electrolytic processing jig is flat, air may remain between the electrolytic processing jig and the processing liquid when the direct electrode is brought into contact with the processing liquid, so that a concern that air bubbles may be generated in the processing liquid is raised. If there are the air bubbles, it is difficult to perform the electrolytic processing appropriately.

Further, if the front surface of the electrolytic processing jig is flat, a surface tension of the processing liquid applied to the electrolytic processing jig is increased when separating the electrolytic processing jig from the processing liquid after the electrolytic processing is finished. Further, to reduce the amount of the processing liquid, the electrolytic processing is performed in a state that the distance between the electrolytic processing jig and the processing liquid is minute. In such a case, it is difficult to form, between the electrolytic processing jig and the processing liquid, a gap through which air is introduced. Furthermore, if the distance between the electrolytic processing jig and the processing liquid is minute, the direct electrode may be attached to the processing target substrate due to the influence from the atmosphere. In such a case, a large force is required for the separation, so that it is difficult to carry out the separation easily.

According to the above-mentioned exemplary embodiment, however, since the front surface of the electrolytic processing jig has the irregularity pattern, the air remaining between the electrolytic processing jig and the processing liquid can be removed through the recesses of the irregularity pattern when the direct electrode is brought into contact with the processing liquid. Therefore, the air bubbles in the processing liquid can be suppressed, so that the electrolytic processing can be performed appropriately.

Furthermore, since the air exists in the recesses of the irregularity pattern as stated above, the contact area between the processing liquid and the front surface of the electrolytic processing jig is reduced as much as the processing liquid does not exist in these recesses. Therefore, the surface tension of the processing liquid applied to the electrolytic processing jig can be reduced. Consequently, the force required to separate the electrolytic processing jig from the processing liquid can be reduced, so that the separation can be carried out easily.

In another exemplary embodiment, there is provided an electrolytic processing jig configured to perform an electrolytic processing on a processing target substrate by using a processing liquid supplied to the processing target substrate. The electrolytic processing jig includes a base body having a flat plate shape; and a direct electrode provided on a front surface of the base body and configured to be brought into contact with the processing liquid to apply a voltage between the processing target substrate and the direct electrode. A through hole is formed in the electrolytic processing jig to be extended from a front surface of the electrolytic processing jig to a rear surface thereof.

According to the present exemplary embodiment, after the electrolytic processing jig is placed at a preset processing position, the processing liquid is supplied into the gap between the electrolytic processing jig and the processing target substrate via the through hole, and the direct electrode is brought into contact with the processing liquid. At this time, even if the air exists between the electrolytic processing jig and the processing target substrate, this air is pushed out by the processing liquid supplied from the through hole. Therefore, the air bubbles in the processing liquid can be suppressed, so that the electrolytic processing can be appropriately performed. Moreover, when separating the electrolytic processing jig from the processing liquid after the electrolytic processing is ended, the processing liquid is pushed out by supplying a fluid (a gas or a liquid) into the gap between the electrolytic processing jig and the processing target substrate through the through hole. As a result, the surface tension of the processing liquid applied to the electrolytic processing jig can be reduced, so that the force required for the separation can also be reduced. Hence, the separation can be performed easily.

In yet another exemplary embodiment, there is provided an electrolytic processing jig configured to perform an electrolytic processing on a processing target substrate by using a processing liquid supplied to the processing target substrate. The electrolytic processing jig includes a base body having a flat plate shape; a direct electrode provided on a front surface of the base body and configured to be brought into contact with the processing liquid to apply a voltage between the processing target substrate and the direct electrode; and a moving device configured to move one end of the base body and the other end thereof in a vertical direction individually.

According to the present exemplary embodiment, when bringing the direct electrode into contact with the processing liquid, the other end of the base body is moved toward the processing target substrate by the moving device from a state in which the base body is inclined from a horizontal direction by placing the one end of the base body closer to the processing target substrate than the other end of the base body. At this time, even if the air exists between the electrolytic processing jig and the processing target substrate, this air is pushed out from the one end side to the other end side. Therefore, the air bubbles in the processing liquid can be suppressed, so that the electrolytic processing can be appropriately performed. In addition, when separating the electrolytic processing jig from the processing liquid after the electrolytic processing is completed, the other end of the base body is moved away from the processing target substrate by the moving device. At this time, air is introduced into an interface between the other end of the processing liquid and the electrolytic processing jig. Accordingly, the surface tension of the processing liquid applied to the electrolytic processing jig can be reduced. As a result, since the force required for the separation can be reduced, the separation can be performed easily.

In still yet another exemplary embodiment, there is provided an electrolytic processing method of performing an electrolytic processing on a processing target substrate by using an electrolytic processing jig. The electrolytic processing jig comprises a base body having a flat plate shape; and a direct electrode provided on a front surface of the base body. An irregularity pattern is formed on a front surface of the electrolytic processing jig. The electrolytic processing method comprises a first process of bringing the direct electrode into contact with the processing liquid on the processing target substrate by moving the electrolytic processing jig and the processing target substrate to be adjacent to each other relatively; and a second process of performing the electrolytic processing on the processing target substrate by applying a voltage between the direct electrode and the processing target substrate. In the first process and the second process, a gas exists in a recess of the irregularity pattern while the direct electrode is kept in contact with the processing liquid.

In still yet another exemplary embodiment, there is provided an electrolytic processing method of performing an electrolytic processing on a processing target substrate by using an electrolytic processing jig. The electrolytic processing jig comprises a base body having a flat plate shape; and a direct electrode provided on a front surface of the base body. A through hole is formed in the electrolytic processing jig to be extended from a front surface of the electrolytic processing jig to a rear surface thereof. The electrolytic processing method comprises a first process of placing the electrolytic processing jig at a preset processing position by moving the electrolytic processing jig and the processing target substrate to be adjacent to each other relatively; a second process of supplying the processing liquid between the electrolytic processing jig and the processing target substrate through the through hole and bringing the direct electrode into contact with the processing liquid; and a third process of performing the electrolytic processing on the processing target substrate by applying a voltage between the direct electrode and the processing target substrate.

In still yet another exemplary embodiment, there is provided an electrolytic processing method of performing an electrolytic processing on a processing target substrate by using an electrolytic processing jig. The electrolytic processing jig comprises a base body having a flat plate shape; a direct electrode provided on a front surface of the base body; and a moving device configured to move one end of the base body and the other end thereof in a vertical direction individually. The electrolytic processing method comprises a first process of bringing the direct electrode into contact with the processing liquid on the processing target substrate by moving the other end of the base body toward the processing target substrate with the moving device from a state in which the base body is inclined from a horizontal direction by placing the one end of the base body closer to the processing target substrate than the other end of the base body; and a second process of performing the electrolytic processing on the processing target substrate by applying a voltage between the direct electrode and the processing target substrate.

Effect of the Invention

According to the exemplary embodiments as described above, the electrolytic processing can be performed on the processing target substrate efficiently and appropriately.

DETAILED DESCRIPTION

Hereinafter, exemplary embodiments will be described with reference to the accompanying drawings. However, it should be noted again that the exemplary embodiments are not limiting the present disclosure.

1. First Exemplary Embodiment

Figure 1:
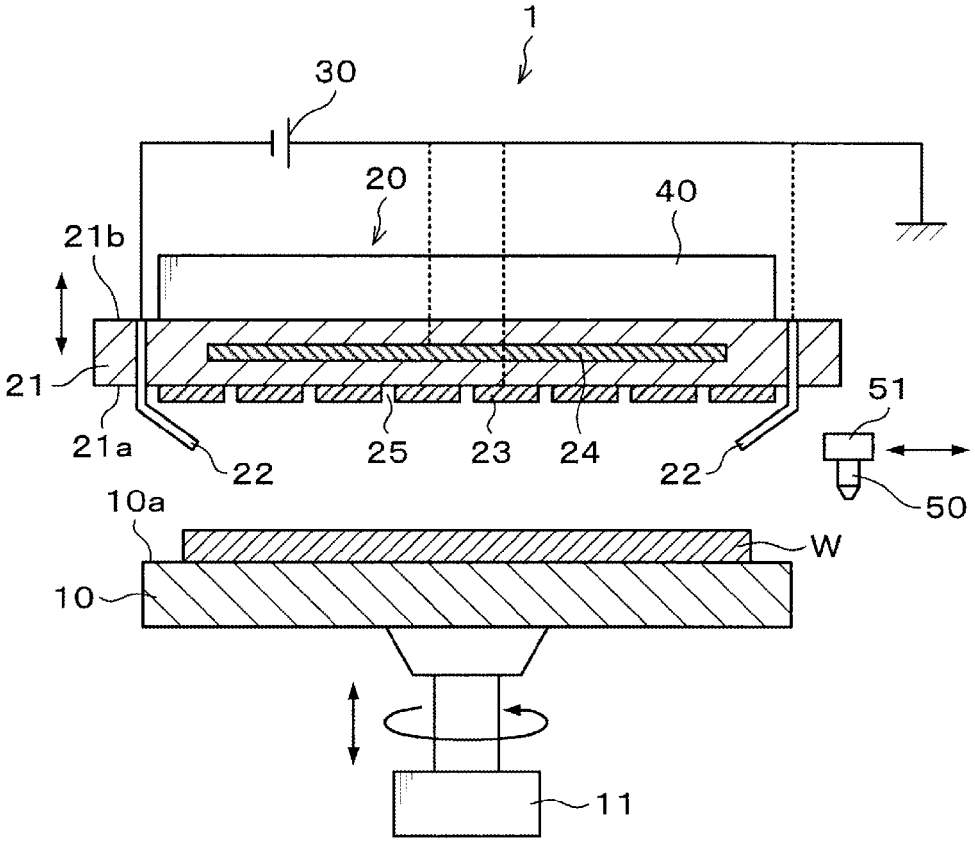
FIG. 1 is a diagram illustrating a schematic configuration of a manufacturing apparatus of a semiconductor device, equipped with an electrolytic processing jig according to a first exemplary embodiment.

A first exemplary embodiment will be described. FIG. 1 is a diagram illustrating a schematic configuration of a manufacturing apparatus of a semiconductor device, equipped with an electrolytic processing jig according to the present exemplary embodiment. A manufacturing apparatus 1 is configured to perform a plating processing as an electrolytic processing on a semiconductor wafer W (hereinafter, simply referred to as "wafer W") as a processing target substrate. This wafer W is provided with a seed layer (not shown) formed on a surface thereof, and this seed layer is used as an electrode. Further, in the various drawings, sizes and dimensions of individual components do not necessarily correspond to actual sizes and dimensions thereof to ease understanding of the present disclosure.

The manufacturing apparatus 1 is equipped with a wafer holding unit 10. The wafer holding unit 10 is a spin chuck configured to hold and rotate the wafer W. The wafer holding unit 10 has a front surface 10*a* having a diameter larger than that of the wafer W when viewed from the top, and this front surface 10*a* is provided with, by way of example, a suction hole (not shown) for attracting the wafer W. The wafer W can be attracted to and held on the wafer holding unit 10 by being suctioned from this suction hole.

The wafer holding unit 10 is equipped with a driving device 11 having, for example, a motor. The wafer holding unit 10 can be rotated at a preset speed by the driving device 11. Further, the driving device 11 is equipped with an elevation driving unit (not shown) such as a cylinder, so the wafer holding unit 10 can be moved vertically.

An electrolytic processing jig 20 is provided above the wafer holding unit 10, facing the wafer holding unit 10. The electrolytic processing jig 20 has a base body 21 made of an insulator. The base body 21 is of a flat plate shape and has a front surface 21*a* having a diameter larger than the diameter of the wafer W when viewed from the top. The base body 21 is equipped with terminals 22, direct electrodes 23 and an indirect electrode 24.

Figure 2:
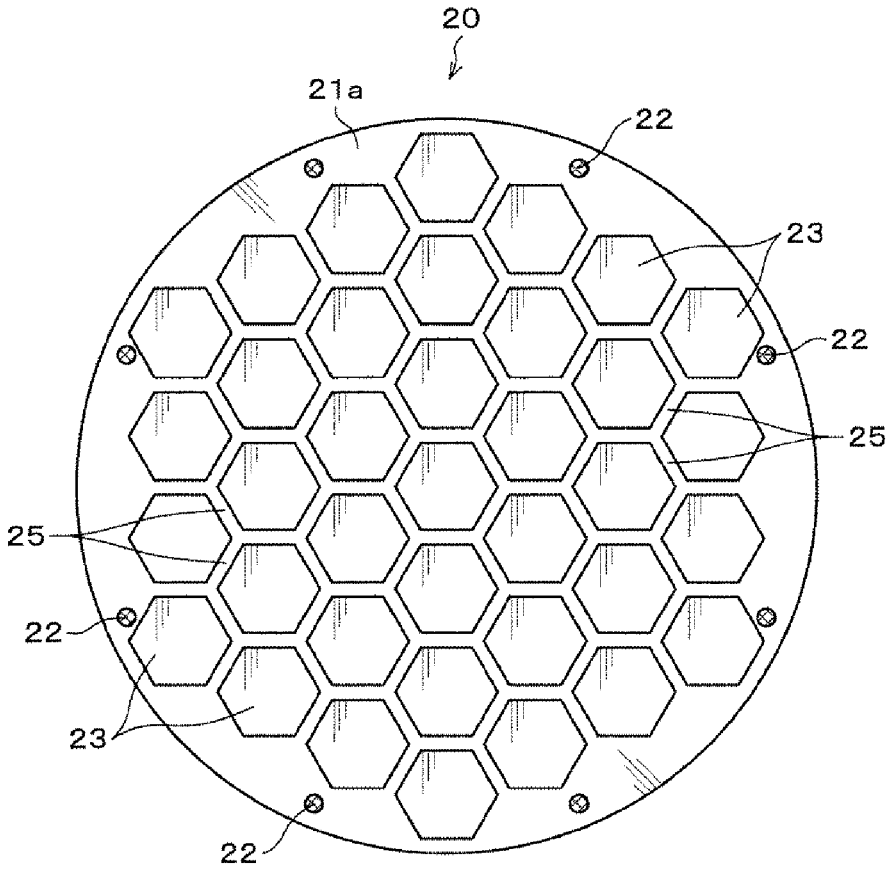
FIG. 2 is a plan view illustrating a schematic configuration of the electrolytic processing jig according to the first exemplary embodiment.

The terminals 22 are protruded from the front surface 21*a* of the base body 21. As shown in FIG. 2, these multiple terminals 22 are provided at a peripheral portion of the base body 21. Further, as depicted in FIG. 1, each terminal 22 is bent and has elasticity. Further, the terminals 22 are arranged such that an imaginary plane formed by leading end portions of the terminals 22, that is, a plane formed by the leading end portions (points) of the respective terminals 22 is substantially parallel to a surface of the wafer W held by the wafer holding unit 10. When a plating processing is performed, the terminals 22 come into contact with a peripheral portion of the seed layer of the wafer W to apply a voltage to the wafer W, as will be described later. Further, the shape of the terminal 22 is not limited to the shown example of the present exemplary embodiment as long as it has elasticity.

As illustrated in FIG. 2, the multiple direct electrodes 23 are provided to be distributed in the entire front surface 21*a* of the base body 21. Each direct electrode 23 has a hexagonal shape when viewed from the top. These multiple direct electrodes 23 are arranged in a substantially honeycomb shape, and adjacent direct electrodes 23 are spaced apart from each other with gaps 25 therebetween. Further, as shown in FIG. 1, these multiple direct electrodes 23 are arranged to face the wafer W held by the wafer holding unit 10 substantially in parallel with the wafer W. As these multiple direct electrode 23 serve as protruding portions and the gaps 25 serve as recesses, a front surface of the electrolytic processing jig 20, that is, a surface of the electrolytic processing jig 20 at the wafer W side is provided with irregularity pattern. Furthermore, as described above, the direct electrodes 23 are distributed in the entire front surface 21*a* of the base body 21, and this irregularity pattern is formed on the entire front surface of the electrolytic processing jig 20 at the wafer W side.

When the plating processing is performed, these multiple direct electrodes 23 are brought into contact with a plating liquid on the wafer W, as will be explained later. Further, when viewed from the top, the shape of the direct electrode 23 is not limited to the shown example of the present exemplary embodiment but the direct electrode 23 may be of, by way of non-limiting example, a circular shape or a rectangular shape.

The indirect electrode 24 is provided within the base body 21. That is, the indirect electrode 24 is not exposed to the outside.

The terminals 22, the direct electrodes 23 and the indirect electrode 24 are connected to a DC power supply 30. The terminals 22 are connected to a cathode side of the DC power supply 30. The direct electrodes 23 and the indirection electrode 24 are connected to an anode side of the DC power supply 30.

A moving device 40 configured to move the base body 21 in the vertical direction is provided at a rear surface 21*b* side of the base body 21. The moving device 40 is equipped with an elevation driving unit (not shown) such as a cylinder. Further, a configuration of the moving device 40 is not particularly limited as long as the base body 21 is movable up and down.

A nozzle 50 for supplying the plating liquid onto the wafer W is provided between the wafer holding unit 10 and the electrolytic processing jig 20. The nozzle 50 is configured to be movable in the horizontal direction and the vertical direction by a moving mechanism 51 to be advanced to and retreated from the wafer holding unit 10. Further, the nozzle 50 communicates with a plating liquid source (not shown) which stores the plating liquid therein, and the plating liquid is supplied from this plating liquid source to the nozzle 50. Further, the plating liquid may be, by way of non-limiting example, a mixed solution of copper sulfate and sulfuric acid, and, in this case, copper ions are included in the plating liquid. Further, in the present exemplary embodiment, though the nozzle 50 is used as a processing liquid supply unit, various other kinds of devices may be used as a mechanism of supplying the plating liquid.

Furthermore, a cup (not shown) configured to receive and collect the liquid dispersed from or falling from the wafer W may be provided around the wafer holding unit 10.

The manufacturing apparatus 1 having the above-described configuration is equipped with a control unit (not shown). The control unit may be, for example, a computer and includes a program storage unit (not shown). The program storage unit stores a program for controlling a processing on the wafer W in the manufacturing apparatus 1. Further, the program may be recorded in a computer-readable recording medium such as a hard disk (HD), a flexible disk (FD), a compact disk (CD), a magnet optical disk (MO) or a memory card, and may be installed from this recording medium to the control unit.

Now, a plating processing in a manufacturing method using the manufacturing apparatus 1 configured as described above will be discussed.

Figure 3:
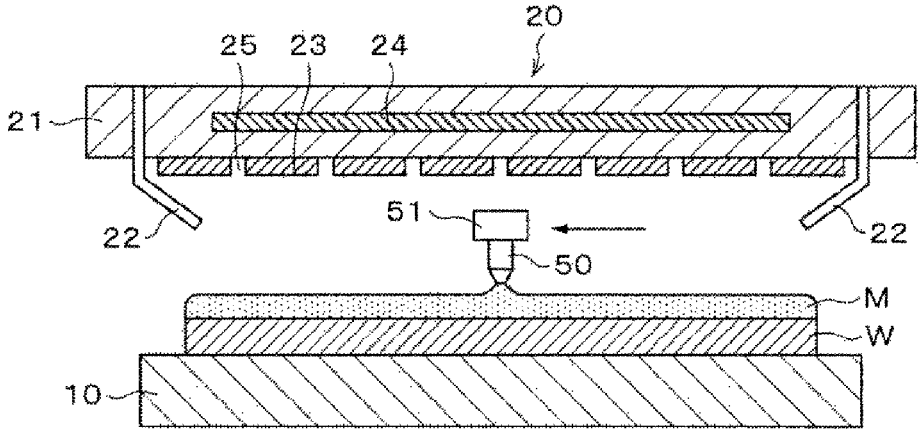
FIG. 3 is a diagram illustrating a state in which a liquid puddle of a plating liquid is formed on a wafer in the first exemplary embodiment.

First, as shown in FIG. 3, in the state that the wafer holding unit 10 and the electrolytic processing jig 20 are placed to face each other, the nozzle 50 is moved, by the moving mechanism 51, to a position above a central portion of the wafer W held by the wafer holding unit 10. At this time, a distance between the front surface 10*a* of the wafer holding unit 10 and the front surface 21*a* of the base body 21 of the electrolytic processing jig 20 is about 100 mm. Thereafter, while rotating the wafer W by the driving device 11, a plating liquid M is supplied to the central portion of the wafer W from the nozzle 50. The supplied plating liquid M is diffused to the entire surface of the wafer W by a centrifugal force. At this time, as the wafer W is rotated, the plating liquid M is uniformly diffused within the surface of the wafer W. Then, if the supply of the plating liquid M from the nozzle 50 is stopped and the rotation of the wafer W is stopped, the plating liquid M stays on the wafer W by a surface tension of the plating liquid M, so that a liquid puddle of the plating liquid M having a uniform thickness is formed.

Figure 4:
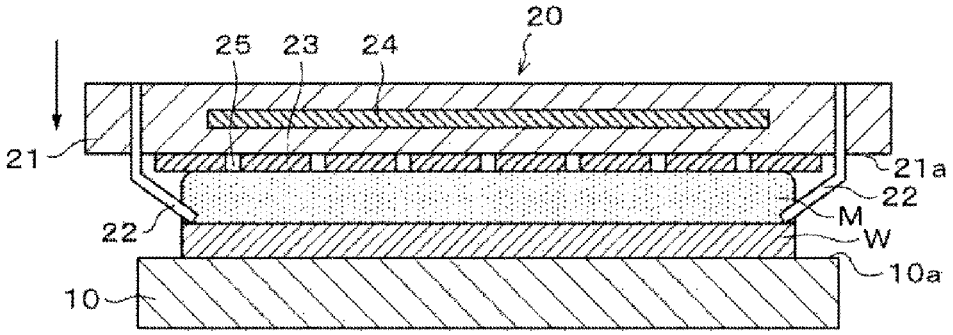
FIG. 4 is a diagram illustrating a state in which the electrolytic processing jig is lowered so that a terminal of the electrolytic processing jig is brought into contact with the wafer and a direct electrode of the electrolytic processing jig is brought into contact with the plating liquid on the wafer in the first exemplary embodiment.

Afterwards, the electrolytic processing jig 20 is lowered by the moving device 40, as shown in FIG. 4. At this time, the distance between the front surface 10*a* of the wafer holding unit 10 and the front surface 21*a* of the base body 21 of the electrolytic processing jig 20 is in the range from about 1 millimeter to several tens of millimeters. Then, the terminals 22 are brought into contact with the wafer W, and the direct electrodes 23 are brought into contact with the plating liquid M on the wafer W. Since the terminals 22 have elasticity, the distance between the front surface 10*a* and the front surface 21*a* in the plating liquid M can be adjusted by adjusting the height of the terminals 22. Then, by applying a preset load to each terminal 22, an electric contact point is formed between the terminal 22 and the wafer W. By applying the load in this way, the electric contact point can be formed sufficiently even in case that the seed layer of the wafer W has a thin film such as a natural oxide film formed on the surface of the seed layer or a highly rigid material, in which the electrical contact point is typically difficult to form, is used.

Figure 5:
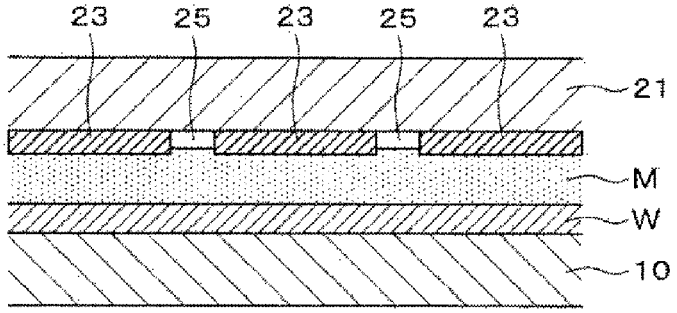
FIG. 5 is a diagram illustrating a state in which the direct electrode is brought into contact with the plating liquid on the wafer in the first exemplary embodiment.

Here, when bringing the direct electrodes 23 into contact with the plating liquid M by lowering the electrolytic processing jig 20, air may enter a gap between the electrolytic processing jig 20 and the plating liquid M, that is, the front surface 21*a* of the base body 21 and the plating liquid M, that is, a gap between the surface of the electrolytic processing jig 20 at the wafer W side and the plating liquid M. Even in this case, it is possible to remove the air through the recesses of the irregularity pattern of the electrolytic processing jig 20, that is, through the gaps 25, as shown in FIG. 5. Accordingly, generation of air bubbles in the plating liquid M can be suppressed. Therefore, adhesion of the air bubbles to surfaces of the direct electrodes 23 can be suppressed, so that stable plating can be carried out.

Figure 6:
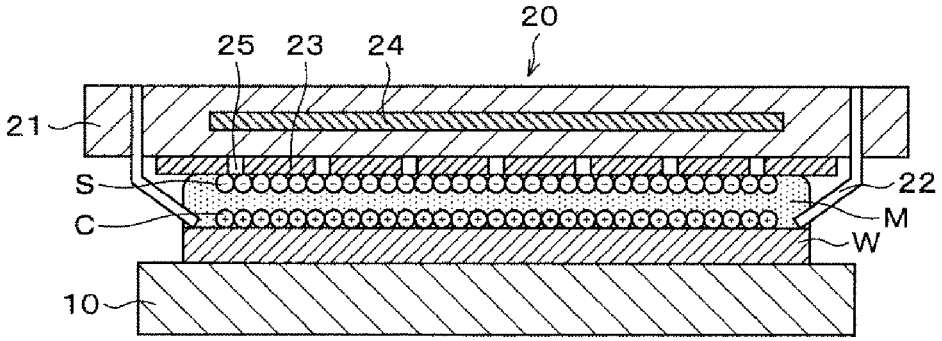
FIG. 6 is a diagram illustrating a state in which a voltage is applied between an indirect electrode and the wafer in the first exemplary embodiment.

Afterwards, an electric field (electrostatic field) is formed by applying a DC voltage with the indirect electrode 24 as the anode and the wafer W as the cathode. As a result, sulfuric acid ions S as negatively charged particles are gathered at the front surface side of the electrolytic processing jig 20 (on the side of the indirect electrode 24 and the direct electrodes 23), and copper ions C as positively charged particles are moved to the surface side of the wafer W, as depicted in FIG. 6.

Here, to avoid the direct electrodes 23 from serving as the cathode, the direct electrodes 23 are set in an electrically floating state without being connected to the ground. In this case, since charge exchange is suppressed in the surfaces of the electrolytic processing jig 20 and the wafer W, the electrically charged particles attracted by the electrostatic field are arranged on the surfaces of the direct electrodes 23. Further, the copper ions C are uniformly arranged on the surface of the wafer W. Further, since the charge exchange of the copper ions C is not performed and electrolysis of water is suppressed on the surface of the wafer W, an electric field can be strengthen when the voltage is applied between the indirect electrode 24 and the wafer W. Further, as the movement of the copper ions C can be accelerated by this high electric field, a plating rate of the plating processing can be improved. Further, by controlling this electric field as required, the copper ions C arranged on the surface of the wafer W is also controlled as required. As stated above, since the generation of the air bubbles on the surfaces of the direct electrodes 23 is suppressed, the copper ions C arranged on the surfaces of the direct electrodes 23 are stabilized.

Figure 7:
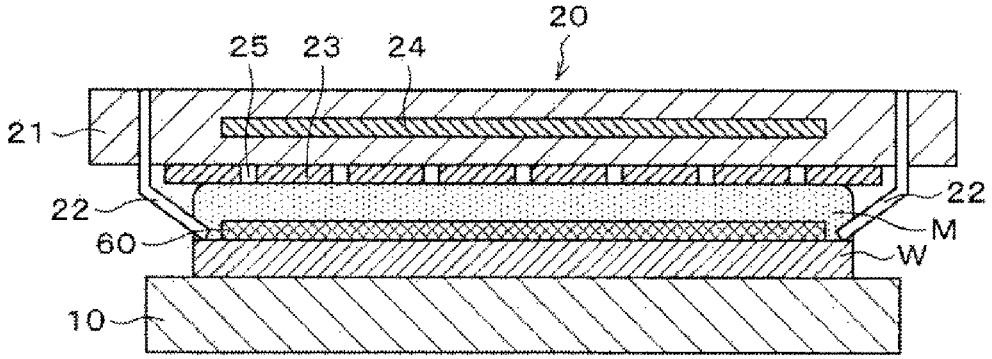
FIG. 7 is a diagram illustrating a state in which a voltage is applied between the direct electrode and the wafer in the first exemplary embodiment.

Then, if a sufficient amount of the copper ions C is moved toward the wafer W side to be accumulated thereon, a voltage is applied with the direct electrodes 23 as the anode and the wafer W as the cathode, so that an electric current is allowed to flow between the direct electrodes 23 and the wafer W. As a result, as depicted in FIG. 7, the charge exchange of the copper ions C uniformly arranged on the surface of the wafer W is performed, so that the copper ions C are reduced and a copper plate 60 is precipitated on the surface of the wafer W. At this time, the sulfuric acid ions S are oxidized by the direct electrodes 23.

Since the copper ions C are reduced in the state that they are sufficiently accumulated to be uniformly arranged on the surface of the W, the copper plate 60 can be uniformly precipitated on the surface of the wafer W. As a consequence, density of crystals in the copper plate 60 is increased, so that the copper plate 60 having high quality can be formed. Further, since the reduction is carried out in the state that the copper ions C are uniformly arranged on the surface of the wafer W, the copper plate 60 can be uniformly formed with high quality.

As the supply of the plating liquid M from the nozzle 50, the movement of the copper ions C by the indirect electrode 24 and the reduction of the copper ions C by the direct electrodes 23 and the wafer W as described above are repeated, the copper plate 60 grows to have a preset film thickness.

Figure 8:
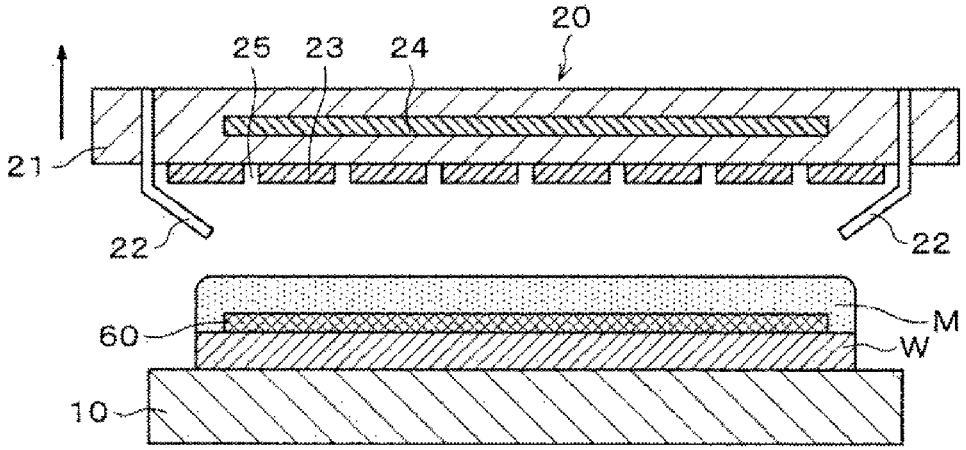
FIG. 8 is a diagram illustrating a state in which the electrolytic processing jig is raised to be separated from the plating liquid in the first exemplary embodiment.

Thereafter, the electrolytic processing jig 20 is raised by the moving device 40, as shown in FIG. 8. At this time, since the air exists in the gaps 25 as mentioned above, the plating liquid M does not exist in the gaps 25. Therefore, a contact area between the plating liquid M and the surface of the electrolytic processing jig 20 is reduced, so that the surface tension of the plating liquid M applied to the electrolytic processing jig 20 can be reduced.

Further, since the irregularity pattern is formed on the entire front surface of the electrolytic processing jig 20, that is, the surface of the electrolytic processing jig 20 at the wafer W side, air is introduced to an interface between an outer peripheral portion of the plating liquid M and the surface of the electrolytic processing jig 20 at the wafer W side. This air contributes to further reducing the surface tension of the plating liquid M applied to the electrolytic processing jig 20. Therefore, a force required to separate the electrolytic processing jig 20 from the plating liquid M can be reduced.

Through the above-described operations, the series of plating processing in the manufacturing apparatus 1 are completed.

According to the exemplary embodiment described above, the plating processing can be appropriately performed on the wafer W in the state that the electrolytic processing jig 20 is placed to face the wafer W and the direct electrodes 23 are in contact with the plating liquid M. Further, since the movement of the copper ions C by the indirect electrode 24 and the reduction of the copper ions C by the direct electrodes 23 and the wafer W are performed individually, the reduction of the copper ions C can be conducted in the state that the copper ions C are sufficiently and uniformly accumulated on the surface of the wafer W. Therefore, the plating processing can be uniformly performed on the surface of the wafer W.

Moreover, according to the present exemplary embodiment, since the surface of the electrolytic processing jig 20 at the wafer W side has the irregularity pattern, the air which enters the gap between the surface of the electrolytic processing jig 20 at the wafer W side and the plating liquid M can be removed through the gaps 25 when the direct electrodes 23 are brought into contact with the plating liquid M by lowering the electrolytic processing jig 20 before the plating processing. Therefore, the generation of the air bubbles in the plating liquid M can be suppressed. Since the adhesion of the air bubbles to the surfaces of the direct electrodes 23 can be suppressed, the stable plating is enabled.

In addition, depending on processing conditions, air bubbles of, for example, a hydrogen gas may be generated during the plating processing. In such a case, these air bubbles generated in the plating processing can be removed through the gaps 25, so that the plating processing can appropriately carried out.

Further, since the surface of the electrolytic processing jig 20 at the wafer W side has the irregularity pattern, the air exists in the gaps 25 when the electrolytic processing jig 20 is raised and separated from the plating liquid M after the plating processing. Therefore, the surface tension of the plating liquid M applied to the electrolytic processing jig 20 can be reduced. Furthermore, since the air is introduced to the interface between the outer peripheral portion of the processing liquid M and the electrolytic processing jig 20, the surface tension of the plating liquid M can be further reduced. Accordingly, the force required to separate the electrolytic processing jig 20 from the plating liquid M can be reduced, so that the separation thereof can be eased.

In the above-described exemplary embodiment, the front surface of the electrolytic processing jig 20 has the irregularity pattern as the direct electrodes 23 serve as the protrusions and the gaps 25 serve as the recesses. However, the irregularity pattern is not limited thereto.

Figure 9:
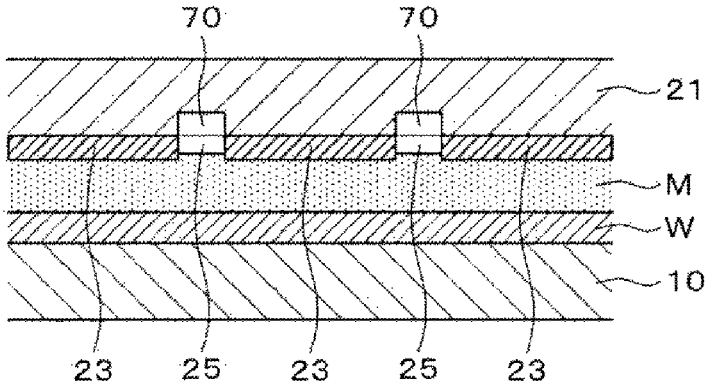
FIG. 9 is a cross sectional view schematically illustrating another configuration of an irregularity pattern of the electrolytic processing jig in the first exemplary embodiment.

As depicted in FIG. 9, grooves 70 may be formed on the front surface 21*a* of the base body 21. The grooves 70 are formed at positions corresponding to the gaps 25. As these gaps 25 and the grooves 70 serve as the recesses while the direct electrodes 23 and portions in the vicinity of the front surface 21*a* of the base body 21 serve as the protrusions, the irregularity pattern is formed on the front surface of the electrolytic processing jig 20.

Figure 10A:
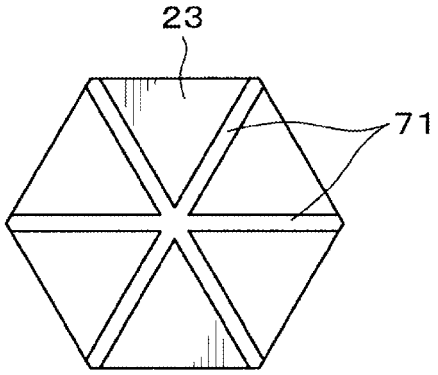
FIG. 10A and FIG. 10B are plan views schematically illustrating yet another configuration of the irregularity pattern of the electrolytic processing jig in the first exemplary embodiment.
Figure 10B:
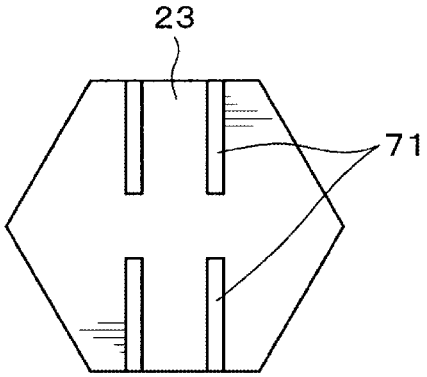

As illustrated in FIG. 10A and FIG. 10B, grooves 71 may be formed on the surface of the direct electrode 23. The grooves 71 may be of any pattern. For example, the grooves 71 may be formed along diagonal lines of the direct electrode 23 as shown in FIG. 10A or a plurality of grooves 71 extended in one direction may be formed as shown in FIG. 10B. In any cases, the grooves 71 serve as the recesses, and the other portions of the direct electrode 23 other than the grooves 71 serve as the protrusions. That is, the irregularity pattern is formed on the direct electrode 23 itself, so that the front surface of the electrolytic processing jig 20 is provided with the irregularity pattern.

Figure 11A:
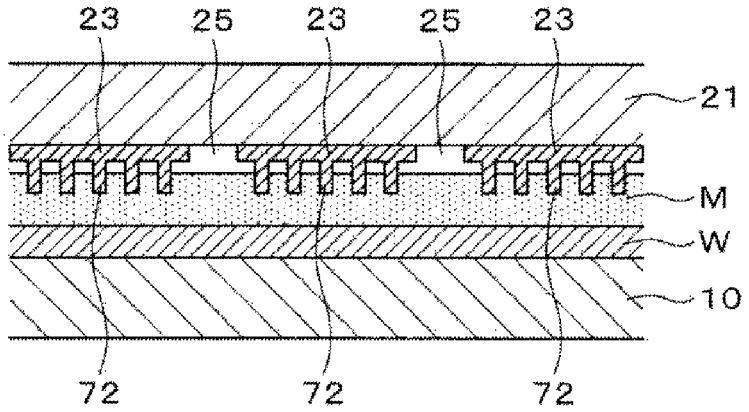
FIG. 11A and FIG. 11B are cross sectional views schematically illustrating still yet another configuration of the irregularity pattern of the electrolytic processing jig in the first exemplary embodiment.
Figure 11B:
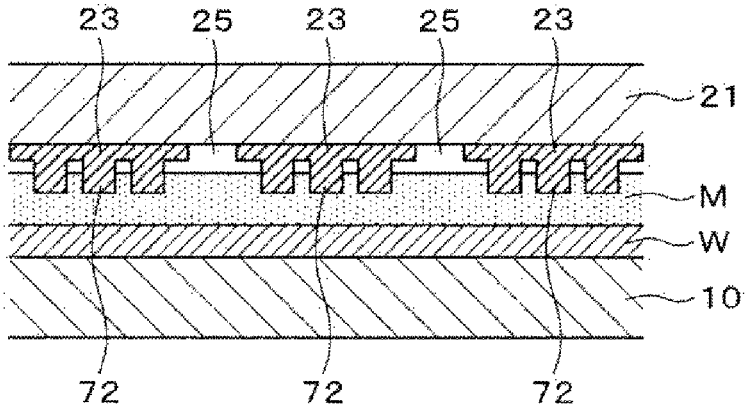

As depicted in FIG. 11A and FIG. 11B, the direct electrode 23 may be provided with a plurality of protrusions 72 projected from the surface thereof. When viewed from the side, the width of the protrusion 72 is not particularly limited. For example, the width of the protrusion 72 may be small as shown in FIG. 11A or may be large as shown in FIG. 11B. In any cases, the irregularity pattern is formed on the direct electrode 23 itself, so that the front surface of the electrolytic processing jig 20 is provided with the irregularity pattern.

Figure 12A:
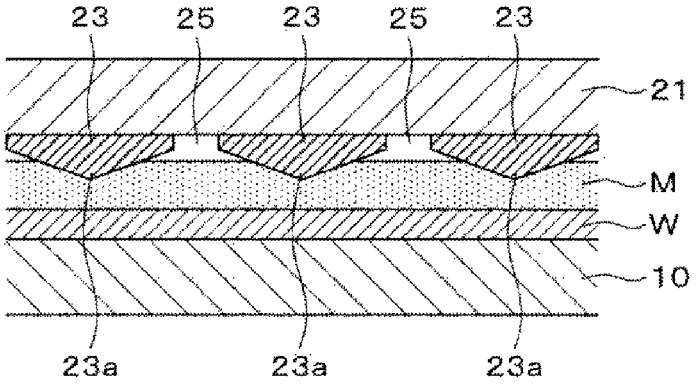
FIG. 12A to FIG. 12C are cross sectional views schematically illustrating still yet another configuration of the irregularity pattern of the electrolytic processing jig in the first exemplary embodiment.
Figure 12B:
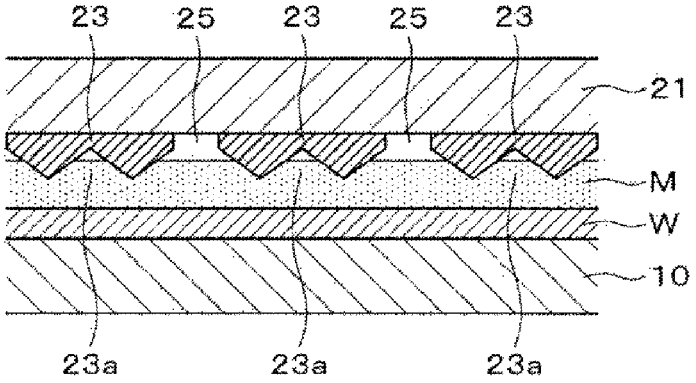
Figure 12C:
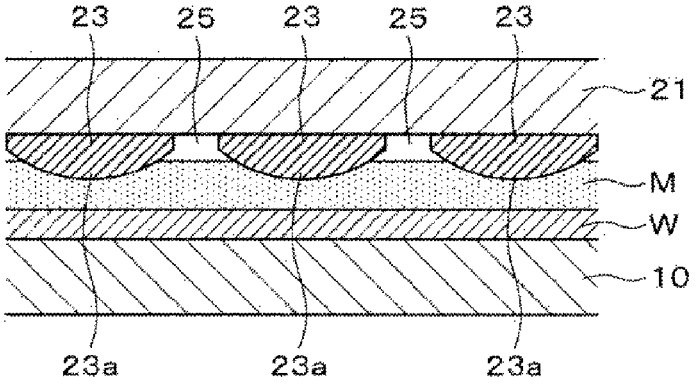

As depicted in FIG. 12A to FIG. 12C, the direct electrode 23 may have a surface 23*a* protruding downwards. That is, the surface 23*a* may form the protrusion. The surface 23*a* may be of any shape. For example, a tip end of the surface 23*a* may be pointed as shown in FIG. 12A and FIG. 12B, and the surface 23*a* may be curved as shown in FIG. 12C. In any cases, an irregularity pattern is formed on the direct electrode 23 itself, so that the front surface of the electrolytic processing jig 20 is provided with an irregularity pattern. Further, as depicted in FIG. 12A and FIG. 12B, the number of the protrusions of the surface 23*a* may not be particularly limited.

Figure 13:
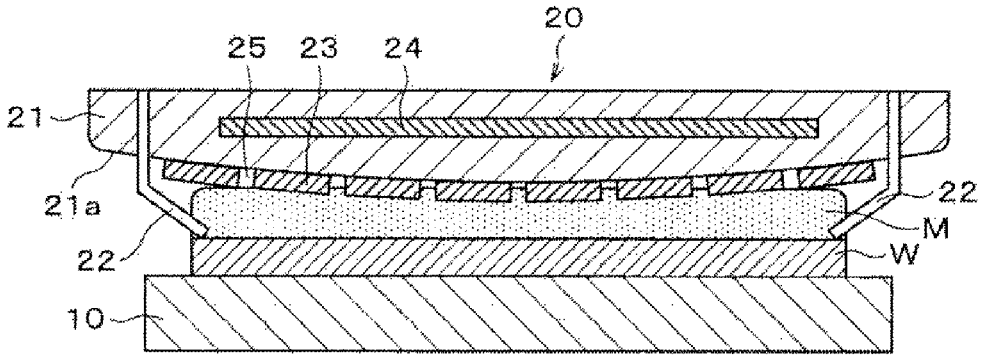
FIG. 13 is a cross sectional view schematically illustrating still yet another configuration of the irregularity pattern of the electrolytic processing jig in the first exemplary embodiment.

As illustrated in FIG. 13, the front surface 21*a* of the base body 21 may be curved protruding downwards. As the front surface 21*a* of the base body 21 is curved in this way, the front surface of the electrolytic processing jig 20 is provided with the irregularity pattern.

In any of FIG. 9 to FIG. 13, since the irregularity pattern is formed on the front surface of the electrolytic processing jig 20, the same effects as stated above can be achieved. That is, the plating processing can be performed appropriately by suppressing the generation of the air bubbles in the plating liquid M, and the electrolytic processing jig 20 can be easily separated from the plating liquid M.

2. Second Exemplary Embodiment

Figure 14:
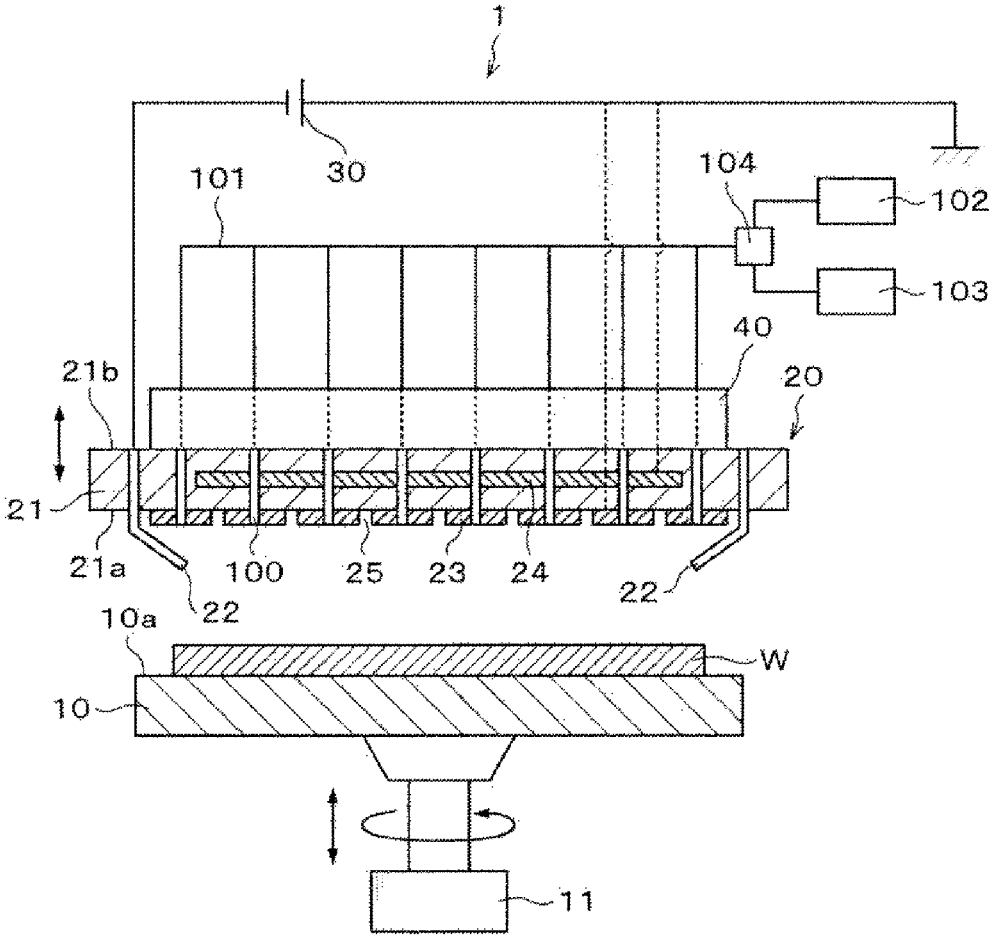
FIG. 14 is a diagram illustrating a schematic configuration of a manufacturing apparatus of a semiconductor device, equipped with an electrolytic processing jig according to a second exemplary embodiment.

Now, a second exemplary embodiment will be explained. FIG. 14 is a diagram illustrating a schematic configuration of a manufacturing apparatus of a semiconductor device, equipped with an electrolytic processing jig according to the second exemplary embodiment. Hereinafter, description will be mainly focused on distinctive features of a manufacturing apparatus 1 of the second exemplary embodiment from the manufacturing apparatus 1 of the first exemplary embodiment.

Figure 15:
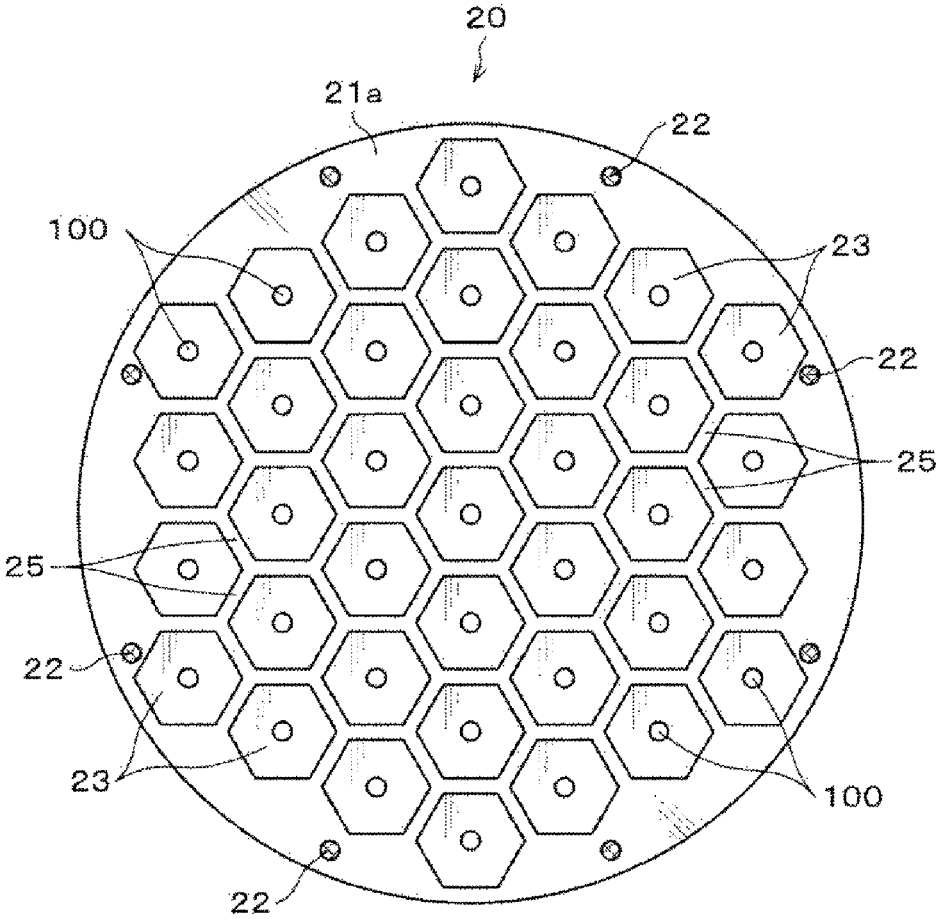
FIG. 15 is a plan view illustrating a schematic configuration of the electrolytic processing jig according to the second exemplary embodiment.

An electrolytic processing jig 20 is provided with through holes 100 extended from the front surface of the electrolytic processing jig 20 to a rear surface thereof. The through hole 100 is formed through a direct electrode 23 and the base body 21, that is, extended from the front surface of the direct electrode 23 to the rear surface 21*b* of the base body 21. As depicted in FIG. 15, the through hole 100 is formed at a central portion of the corresponding direct electrode 23. Further, the through hole 100 may be configured to be opened or closed.

As depicted in FIG. 14, the through holes 100 are connected to a pipeline 101. The pipeline 101 is connected to an air source 102 configured to supply air and a plating liquid source 103 configured to supply the plating liquid M. Further, the pipeline 101 is provided with a valve 104 configured to switch the supply of the air from the air source 102 and the supply of the plating liquid M from the plating liquid source 103.

Further, in the manufacturing apparatus 1 according to the second exemplary embodiment, since the plating liquid M is supplied through the pipeline 101 and the through holes 100 from the plating liquid source 103, the nozzle 50 and the moving mechanism 51 of the first exemplary embodiment can be omitted. Since the other configuration of the manufacturing apparatus 1 of the second exemplary embodiment is the same as the configuration of the manufacturing apparatus 1 of the first exemplary embodiment, redundant description will be omitted.

Now, a plating processing in a manufacturing method using the manufacturing apparatus 1 configured as described above will be discussed.

Figure 16:
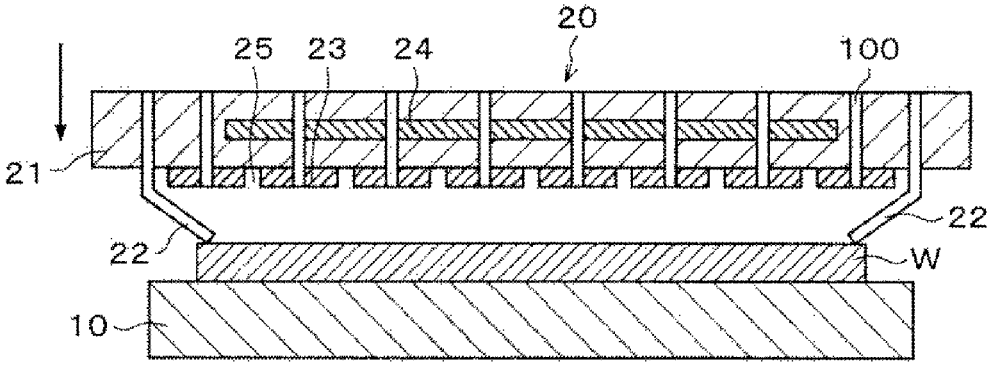
FIG. 16 is a diagram illustrating a state in which the electrolytic processing jig is lowered and a terminal thereof is brought into contact with a wafer in the second exemplary embodiment.

First, as shown in FIG. 16, the electrolytic processing jig 20 is lowered by the moving device 40. Then, the terminal 22 is brought into contact with the wafer W.

Figure 17:
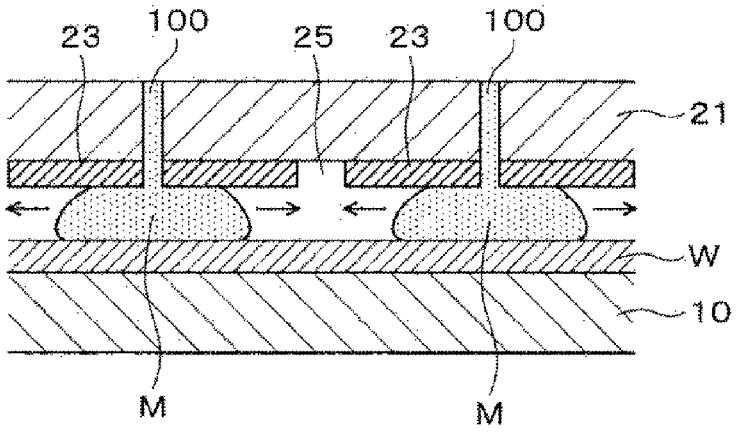
FIG. 17 is a diagram illustrating a state in which a plating liquid is supplied from through holes in the second exemplary embodiment.
Figure 18:
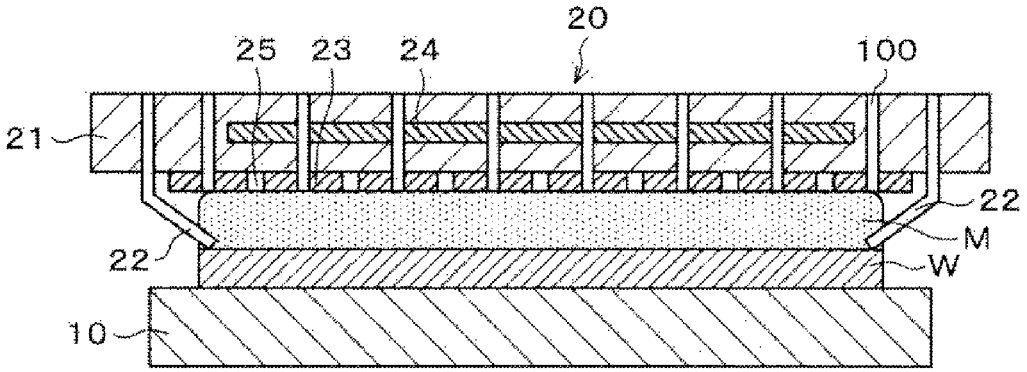
FIG. 18 is a diagram illustrating a state in which the plating liquid is filled between the electrolytic processing jig and the wafer and a direct electrode is brought into contact with the plating liquid on the wafer in the second exemplary embodiment.

Then, the through holes 100 are connected to the plating liquid source 103 by the valve 104, and the plating liquid M is supplied to a gap between the electrolytic processing jig 20 and the wafer W through the through hole 100, as depicted in FIG. 17. Air existing between the surface of the electrolytic processing jig 20 at the wafer W side and the wafer W is pushed out from the gap between the electrolytic processing jig 20 and the wafer W by the plating liquid M, so that the generation of the air bubbles in the plating liquid M can be suppressed. Then, as depicted in FIG. 18, the plating liquid M is filled between the electrolytic processing jig 20 and the wafer W, and the direct electrodes 23 come into contact with the plating liquid M.

Thereafter, by applying the DC voltage with the indirect electrode 24 as the anode and the wafer W as the cathode, the electric field (electrostatic field) is formed. Accordingly, sulfuric acid ions S as negatively charged particles are moved to the front surface side of the electrolytic processing jig 20, and the copper ions C as positively charged particles are moved to the front surface side of the wafer W. Further, since the movement of the copper ions C by the indirect electrode 24 is the same as the process described in the first exemplary embodiment, detailed description thereof will be omitted here.

Afterwards, by applying the voltage while using the direct electrodes 23 as the anode and the wafer W as the cathode, the copper plate 60 is formed on the front surface of the wafer W. This formation of the copper plate 60 (reduction of the copper ions C) is the same as the process described in the first exemplary embodiment, detailed description thereof will be omitted.

Figure 19:
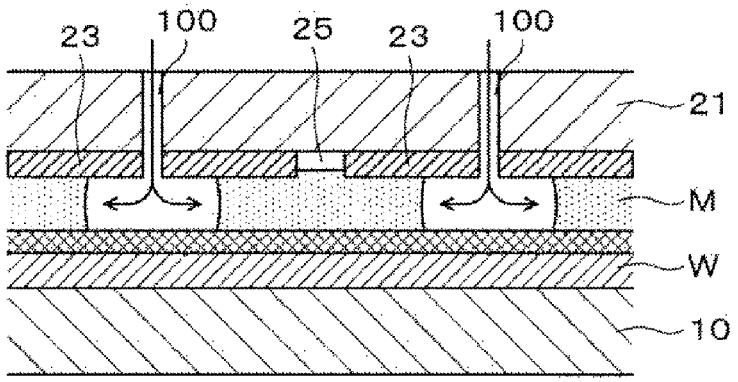
FIG. 19 is a diagram illustrating a state in which air is supplied from the through holes in the second exemplary embodiment.
Figure 20:
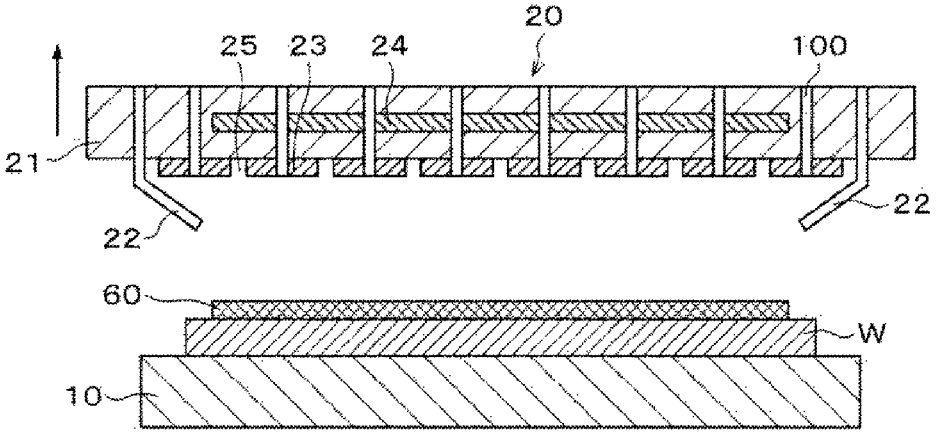
FIG. 20 is a diagram illustrating a state in which the electrolytic processing jig is raised to be separated from the plating liquid in the second exemplary embodiment.

Then, when separating the electrolytic processing jig 20 from the plating liquid M, the through holes 100 are connected to the air source 102 by the valve 104, and the air is supplied between the surface of the electrolytic processing jig 20 at the wafer W side and the wafer W through the through holes 100, as depicted in FIG. 19. Accordingly, the plating liquid M is pushed out from the gap between the electrolytic processing jig 20 and the wafer W by the air. At this time, since a contact area between the plating liquid M and the electrolytic processing jig 20 is reduced, a surface tension of the plating liquid M applied to the electrolytic processing jig 20 can be reduced. Then, in this state, the electrolytic processing jig 20 is raised by the moving device 40, as illustrated in FIG. 20. Thus, the force required to separate the electrolytic processing jig 20 from the plating liquid M can be reduced, so that the separation can be easily carried out.

Through the operations as stated above, the series of plating processing in the manufacturing apparatus 1 are ended.

In the present second exemplary embodiment, the same effects as in the first exemplary embodiment can be achieved. That is, the plating processing can be appropriately performed by suppressing the generation of the air bubbles in the plating liquid M, and, further, the electrolytic processing jig 20 can be easily separated from the plating liquid M.

In the above-described exemplary embodiment, the through holes 100 are connected to the air source 102 and the plating liquid source 103. However, another type of supply source may be provided to supply another type of fluid to the through holes 100.

By way of example, although the air is supplied into the gap between the electrolytic processing jig 20 and the wafer W when separating the electrolytic processing jig 20 from the plating liquid M, it may be possible to supply a liquid, such as, but not limited to, water, instead of the air.

Moreover, in the manufacture of the semiconductor device, various kinds of liquid processings are performed before and after the plating processing. By way of example, when performing a cleaning processing before the plating processing, a cleaning liquid such as DIW or IPA is supplied onto the wafer W. The processing liquid such as this cleaning liquid may be supplied onto the wafer W through the through holes 100.

Further, in the above-described exemplary embodiment, though the through holes 100 serve as supply holes through which the air or the plating liquid M is supplied, a part of the multiple through holes 100 may be used as discharge holes for the air or the plating liquid M. In such a case, when supplying the plating liquid M into the gap between the surface of the electrolytic processing jig 20 at the wafer W side and the wafer W, the air existing between the electrolytic processing jig 20 and the wafer W is also discharged from the through holes 100 serving as the discharge holes. Further, when separating the electrolytic processing jig 20 from the plating liquid M, the plating liquid M existing between the electrolytic processing jig 20 and the wafer W is also discharged through the through holes 100 serving as the discharge holes. Accordingly, the effect of suppressing the generation of the air bubbles in the plating liquid M and the effect of the separation of the electrolytic processing jig 20 from the plating liquid M can be further improved.

Figure 21:
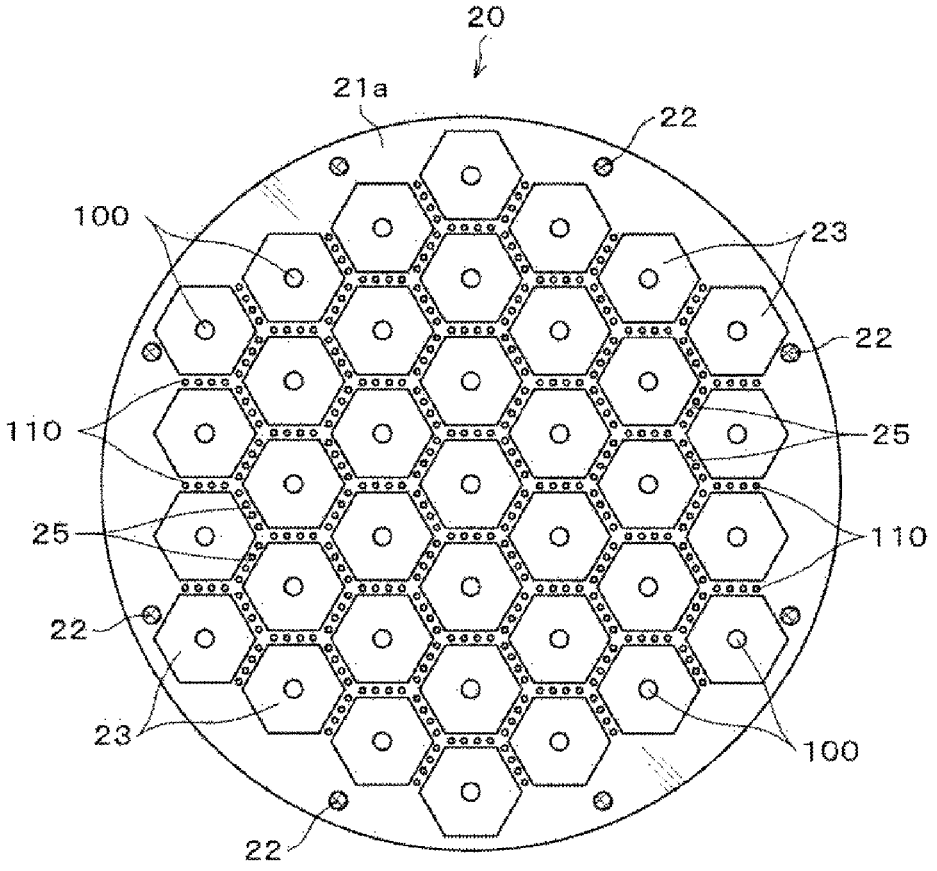
FIG. 21 is a plan view schematically illustrating another configuration of the electrolytic processing jig according to the second exemplary embodiment.

In the above-described exemplary embodiment, though the electrolytic processing jig 20 is provided with the through holes 100 formed through the direct electrodes 23 and the base body 21, the electrolytic processing jig 20 may be further provided with through holes 110, as illustrated in FIG. 21. The through holes 110 are formed in the gaps 25 to be extended from the front surface 21*a* of the base body 21 to the rear surface 21*b* thereof. Further, the number of the through holes 110 formed in each gap 25 is plural. These through holes 110 are connected to the air source 102 and the plating liquid source 103, the same as the through holes 100, and have the same functions as those of the through holes 100. By forming the through holes 110 in addition to the through holes 100, the effect of suppressing the generation of the air bubbles in the plating liquid M and the effect of the separation of the electrolytic processing jig 20 from the plating liquid M can be further ameliorated.

Further, only the through holes 110, instead of the through holes 100, may be formed at the electrolytic processing jig 20. Further, a part of the multiple through holes 110 may be used as discharge holes for the air or the plating liquid M. Furthermore, the through holes 110 may be configured to be opened or closed.

3. Third Exemplary Embodiment

Figure 22:
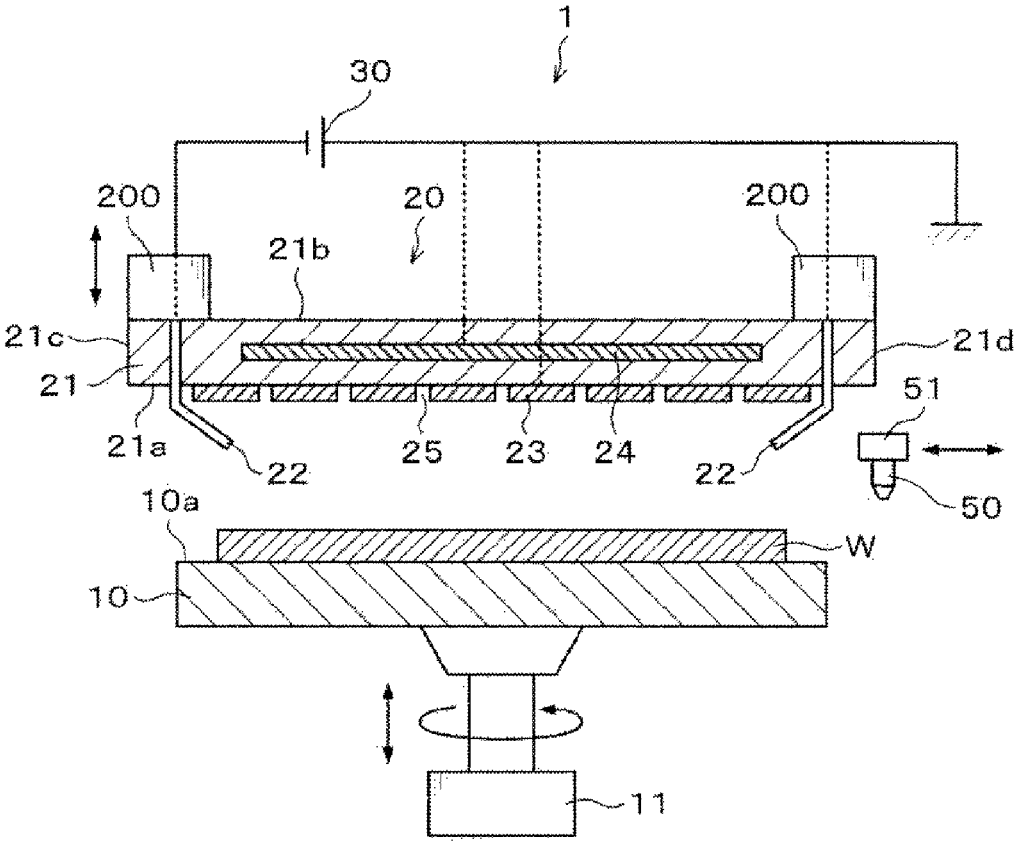
FIG. 22 is a diagram illustrating a schematic configuration of a manufacturing apparatus of a semiconductor device, equipped with an electrolytic processing jig according to a third exemplary embodiment.

Now, a third exemplary embodiment will be explained. FIG. 22 is a diagram illustrating a schematic configuration of a manufacturing apparatus of a semiconductor device, equipped with an electrolytic processing jig according to the third exemplary embodiment. Hereinafter, description will be mainly focused on distinctive features of a manufacturing apparatus 1 of the third exemplary embodiment from the manufacturing apparatus 1 of the first exemplary embodiment.

In the manufacturing apparatus 1, multiple moving devices 200 are provided instead of the moving device 40 of the first exemplary embodiment. The moving device 200 is configured to move one end 21*c* and the other end 21*d* of a periphery of the base body 21 in the vertical direction individually. The moving device 200 is equipped with an elevation driving unit (not shown) such as a cylinder. Further, a configuration of the moving device 200 is not particularly limited as long as it is capable of moving the base body 21 up and down.

Further, since the other configuration of the manufacturing apparatus 1 of the third exemplary embodiment is the same as the configuration of the manufacturing apparatus 1 of the first exemplary embodiment, redundant description will be omitted.

Now, a plating processing in a manufacturing method using the manufacturing apparatus 1 configured as described above will be discussed.

First, the liquid puddle of the plating liquid M is formed on the wafer W by using the nozzle 50. Since this formation of the liquid puddle is the same as the process described in the first exemplary embodiment, detailed description thereof will be omitted.

Figure 23:
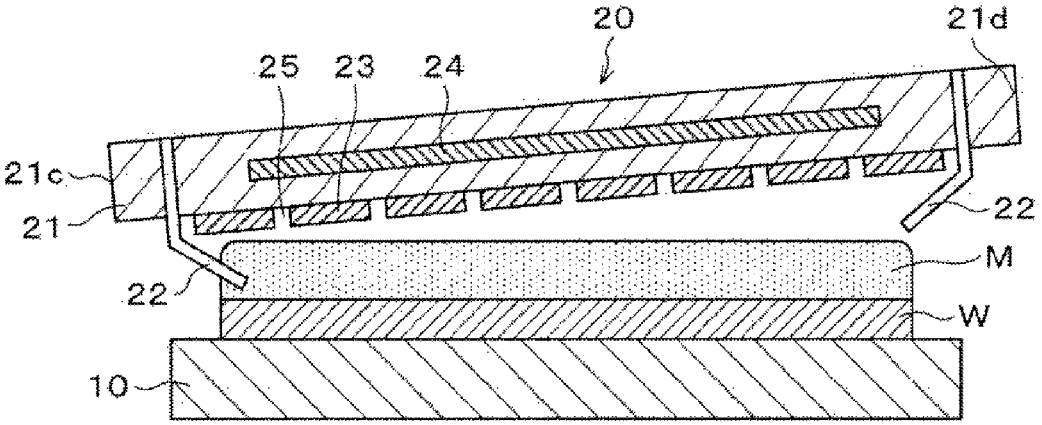
FIG. 23 is a diagram illustrating a state in which the electrolytic processing jig is arranged to be inclined in the third exemplary embodiment.

Then, as depicted in FIG. 23, the one end 21*c* of the base body 21 is located under the other end 21*d* thereof by the moving device 200. That is, the base body 21 is inclined from the horizontal direction. An inclination angle of the base body 21 may be, by way of example, 5 degrees. Here, the one end 21*c* of the base body 21 is located at a preset processing position (processing height).

Figure 24:
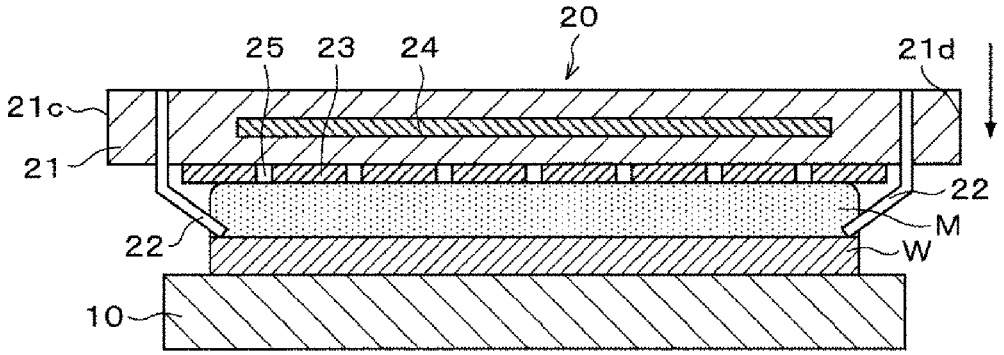
FIG. 24 is a diagram illustrating a state in which the other end of the electrolytic processing jig is lowered so that a terminal thereof is brought into contact with a wafer and a direct electrode is brought into contact with a plating liquid on the wafer in the third exemplary embodiment.

Subsequently, the other end 21*d* of the base body 21 is lowered by the moving device 200, as shown in FIG. 24. At this time, the one end 21*c* is not moved, and the base body 21 is pivoted around the one end 21*c* in an up-and-down direction. Then, the terminals 22 are brought into contact with the wafer W, and the direct electrodes 23 are brought into contact with the plating liquid M on the wafer W.

Here, the air existing in the gap between the electrolytic processing jig 20 and the wafer W is pushed out from the one end 21*c* to the other end 21*d*. Therefore, the generation of the air bubbles in the plating liquid M can be suppressed.

Thereafter, by applying the DC voltage while using an indirect electrode 24 as the anode and the wafer W as the cathode, the electric field (electrostatic field) is formed. Accordingly, the sulfuric acid ions S as negatively charged particles are moved to a front surface side of the electrolytic processing jig 20, and the copper ions C as positively charged particles are moved to the front surface side of the wafer W. Further, since the movement of the copper ions C is the same as the process described in the first exemplary embodiment, detailed description thereof will be omitted here.

Afterwards, by applying the voltage while using the direct electrodes 23 as the anode and the wafer W as the cathode, the copper plate 60 is formed on the front surface of the wafer W. This formation of the copper plate 60 (reduction of the copper ions C) is the same as the process described in the first exemplary embodiment, detailed description thereof will be omitted.

Figure 25:
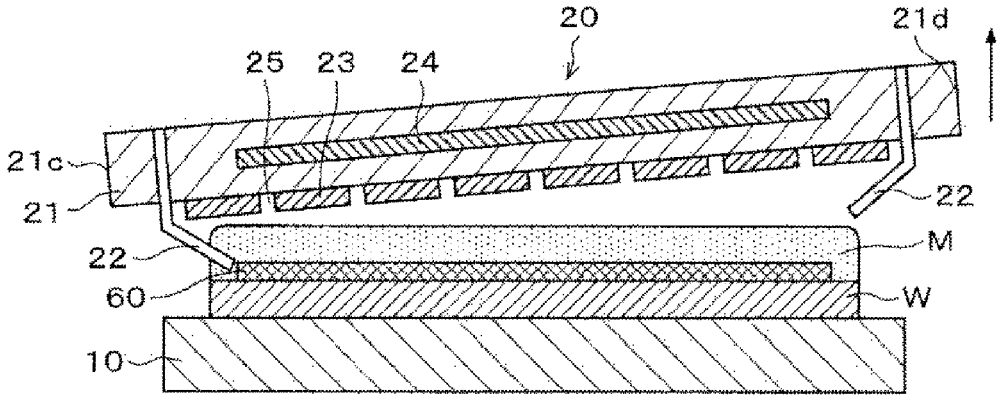
FIG. 25 is a diagram illustrating a state in which the other end of the electrolytic processing jig is raised to be separated from the plating liquid in the third exemplary embodiment.

Then, when separating the electrolytic processing jig 20 from the plating liquid M, the other end 21*d* of the base body 21 is raised by the moving device 200, as shown in FIG. 25. At this time, the one end 21*c* is not moved, and the base body 21 is pivoted around the one end 21*c* in the up-and-down direction.

Figure 26:
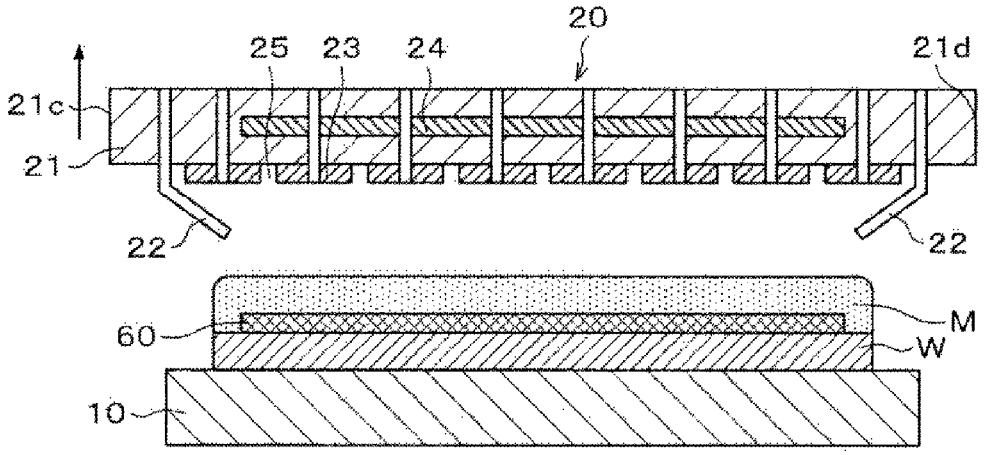
FIG. 26 is a diagram illustrating a state in which the electrolytic processing jig is separated from the plating liquid in the third exemplary embodiment.

At this time, air is introduced from the interface between the electrolytic processing jig 20 and the plating liquid M at the side of the other end 21*d*, that is, an opening between the electrolytic processing jig 20 and the plating liquid M formed at the side of the other end 21*d*. Accordingly, a contact area between the plating liquid M and the front surface of the electrolytic processing jig 20 is reduced, and a surface tension of the plating liquid M applied to the electrolytic processing jig 20 can be reduced. Then, in this state, the electrolytic processing jig 20 is separated from the plating liquid M, as illustrated in FIG. 26. Thus, the force required for the separation can be reduced, so that the separation can be easily carried out.

Through the operations as stated above, the series of plating processing in the manufacturing apparatus 1 are ended.

In this third exemplary embodiment, the same effects as in the first exemplary embodiment can be achieved. That is, the plating processing can be appropriately performed by suppressing the generation of the air bubbles in the plating liquid M, and, further, the electrolytic processing jig 20 can be easily separated from the plating liquid M.

4. Other Exemplary Embodiments

In the above-described exemplary embodiments, the terminals 22 are brought into contact with the wafer W by lowering the electrolytic processing jig 20 through the moving device 40. In the manufacturing apparatus 1, however, the wafer holding unit 10 may be raised by the driving device 11. Alternatively, both the electrolytic processing jig 20 and the wafer holding unit 10 may be moved. Still more, the placement of the electrolytic processing jig 20 and the wafer holding unit 10 may be reversed, and the electrolytic processing jig 20 may be placed under the wafer holding unit 10.

In the above-described exemplary embodiments, the wafer holding unit 10 is configured as the spin chuck. Instead, a cup having an open top and storing therein the plating liquid M may be used.

The above exemplary embodiments have been described for an example where the plating processing is performed as the electrolytic processing. However, the present disclosure may be applicable to various kinds of electrolytic processing such as etching processing.

Further, the exemplary embodiments have been described for the example where the copper ions C are reduced on the front surface side of the wafer W. However, the present disclosure is also applicable to a case where processing target ions are oxidized at the front surface side of the wafer W. In such a case, the processing target ions are negative ions, and the same electrolytic processing may be performed while setting the anode and the cathode in the reverse way. In this exemplary embodiment, though there is a difference between the oxidation and the reduction of the processing target ions, the same effects as those of the above-described exemplary embodiments can be achieved.

From the foregoing, it will be appreciated that the exemplary embodiment of the present disclosure has been described herein for purposes of illustration, and that various modifications may be made without departing from the scope and spirit of the present disclosure. Accordingly, the embodiment disclosed herein is not intended to be limiting. The scope of the inventive concept is defined by the following claims and their equivalents rather than by the detailed description of the exemplary embodiment. It shall be understood that all modifications and embodiments conceived from the meaning and scope of the claims and their equivalents are included in the scope of the inventive concept.

EXPLANATION OF CODES

1: Manufacturing apparatus
20: Electrolytic processing jig
21: Base body
22: Terminal
23: Direct electrode
24: Indirect electrode
25: Gap

40: Moving device
60: Copper plate
70: Groove
71: Groove
72: Protrusion
100: Through hole
110: Through hole
200: Moving device
C: Copper ion
M: Plating liquid
S: Sulfuric acid ion
W: Wafer (semiconductor wafer)

We claim:

1. An electrolytic processing jig configured to perform an electrolytic processing on a processing target substrate by using a processing liquid supplied to the processing target substrate the electrolytic processing jig comprising:

a base body provided above the processing target substrate and having a flat plate shape;

a direct electrode provided on a front surface of the base body and configured to be brought into contact with the processing liquid supplied on the processing target substrate to apply a voltage between the processing target substrate and the direct electrode;

a moving device configured to move the base body in a vertical direction; and a terminal having elasticity, protruded from the front surface of the base body, and configured to apply a voltage to the processing target substrate, wherein an irregularity pattern is formed on a front surface of the electrolytic processing jig, the direct electrode provided on the front surface of the base body includes multiple direct electrodes, and the irregularity pattern is formed by a gap between adjacent electrodes of the multiple direct electrodes.

2. The electrolytic processing jig of claim 1, wherein the irregularity pattern is formed on the entire front surface of the electrolytic processing jig.

3. The electrolytic processing jig of claim 1, wherein the irregularity pattern is formed by providing a protrusion on a front surface of the direct electrode.

4. The electrolytic processing jig of claim 3, wherein the protrusion formed on the front surface of the direct electrode is plural in number.

5. The electrolytic processing jig of claim 1, wherein the irregularity pattern is formed by protrudingly curving the front surface of the base body.

6. The electrolytic processing jig of claim 1, further comprising:

an indirect electrode configured to form an electric field in the processing liquid.

* * * * *